United States Patent [19]

Wheeler

[11] Patent Number: 4,760,962

[45] Date of Patent: Aug. 2, 1988

[54] SPRAY GUN PAINT CUP AND LID ASSEMBLY

[75] Inventor: Roger D. Wheeler, Maumee, Ohio

[73] Assignee: The DeVilbiss Company, Toledo, Ohio

[21] Appl. No.: 115,126

[22] Filed: Oct. 30, 1987

[51] Int. Cl.[4] ..... B05B 15/00

[52] U.S. Cl. ..... 239/289; 239/346; 239/353; 239/354; 239/367; 239/373

[58] Field of Search ..... 239/289, 346, 354, 353, 239/367, 373, 375, 378, 526, 527, 528

[56] References Cited

U.S. PATENT DOCUMENTS

| | | | |
|---|---|---|---|
| Re. 30,968 | 6/1982 | Grant | 222/111 |
| 2,005,776 | 6/1935 | Downs | 239/289 |
| 2,904,262 | 9/1959 | Peeps | 239/346 |
| 2,934,246 | 4/1960 | Briggs | 239/289 |

OTHER PUBLICATIONS

"Air Spray Guns-Manual, Automatic, Special Purpose", p. 5, 1978, De Vilbiss.

*Primary Examiner*—Andres Kashnikow
*Assistant Examiner*—Michael J. Forman
*Attorney, Agent, or Firm*—MacMillan, Sobanski & Todd

[57] ABSTRACT

A paint cup and lid assembly for a spray gun of the type operated from a source of compressed air. A shroud connects the paint cup to the spray gun. The shroud is indexed between a first position which provides for pressure assisted paint feed and a second position which provides for suction paint feed.

5 Claims, 2 Drawing Sheets

SPRAY GUN PAINT CUP AND LID ASSEMBLY

TECHNICAL FIELD

The invention relates to paint spray guns of the hand held type and more particularly to an improved paint cup and lid assembly for a hand held spray gun of the type connected to a source of compressed air. The paint cup is selectively operated for suction paint feed or for pressurized paint feed.

BACKGROUND ART

A commonly used type of hand held paint spray guns has a paint cup attached to extend below a barrel portion of the gun. Compressed air is supplied to the gun through a hose attached to the butt of a handle. The compressed air is supplied under the control of a trigger actuated valve to a nozzle for atomizing paint and often for shaping the pattern of the atomized paint. In one type of spray gun, when a trigger actuated fluid valve is opened, the flow of compressed air aspirates or sucks paint from a paint cup into the nozzle where the compressed air carries the paint through an orifice and atomizes the paint. For this type of spray gun to function, the paint cup must be vented to atmosphere. Otherwise, as paint is consumed, a vacuum will build up in the paint cup and paint feed will cease. In another type of spray gun, a portion of the compressed air is supplied to the interior of the paint cup for pressurizing the paint cup. The pressure causes the paint to flow from the cup to the nozzle, where it is discharged with air through an orifice and atomized when a trigger actuated fluid valve is opened. Pressure assisted paint feed is used with paints which are too viscous for suction feed or for applications where fast coverage is more important than the quality of the finish.

In the past, most spray guns of the suction feed type were not designed to operate satisfactorily in a pressurized feed mode since they were not constructed to supply compressed air to the paint cup. If a separate compressed air line is connected from the compressed air source to the paint cup, paint can flow into the atomization air and pattern shaping air passages if the paint pressure exceeds the air pressure in the spray gun.

DISCLOSURE OF INVENTION

A conventional hand held spray gun of the type connected to a compressed air source and designed for suction paint feed from a paint cup is modified according to the invention to include a threaded nipple from which the paint feed tube extends. An atomization air passage downstream from a trigger actuated air valve is provided with an outlet adjacent the nipple. An upper end of a shroud is attached to the nipple by means of a threaded retainer sleeve and a lower end of the shroud is attached to a paint cup. The shroud and the spray gun cooperate to permit orientation of the shroud in first and second positions relative to the spray gun. In the first shroud position, a passage in the upper shroud end aligns with the compressed air opening in the spray gun and the paint cup is closed to atmosphere to provide for pressurized paint feed. Since the paint cup is pressurized with atomization air from the spray gun, the paint pressure will never be higher than the air pressure and paint will not flow into the air passages in the spray gun. In the second shroud position, the compressed air opening on the spray gun is blocked and the shroud passage connects to a vent passage or notch in the spray gun which vents the paint cup to atmosphere for suction paint feed.

Accordingly, it is an object of the invention to provide an improved spray gun paint cup and lid assembly.

Another object of the invention is to provide a paint cup and lid assembly for a spray gun capable of operating either in a pressurized feed mode or in a suction feed mode.

Other objects and advantages of the invention will be apparent from the following detailed description and the accompanying drawings.

BEST MODE FOR CARRYING OUT THE INVENTION

Figure 1:
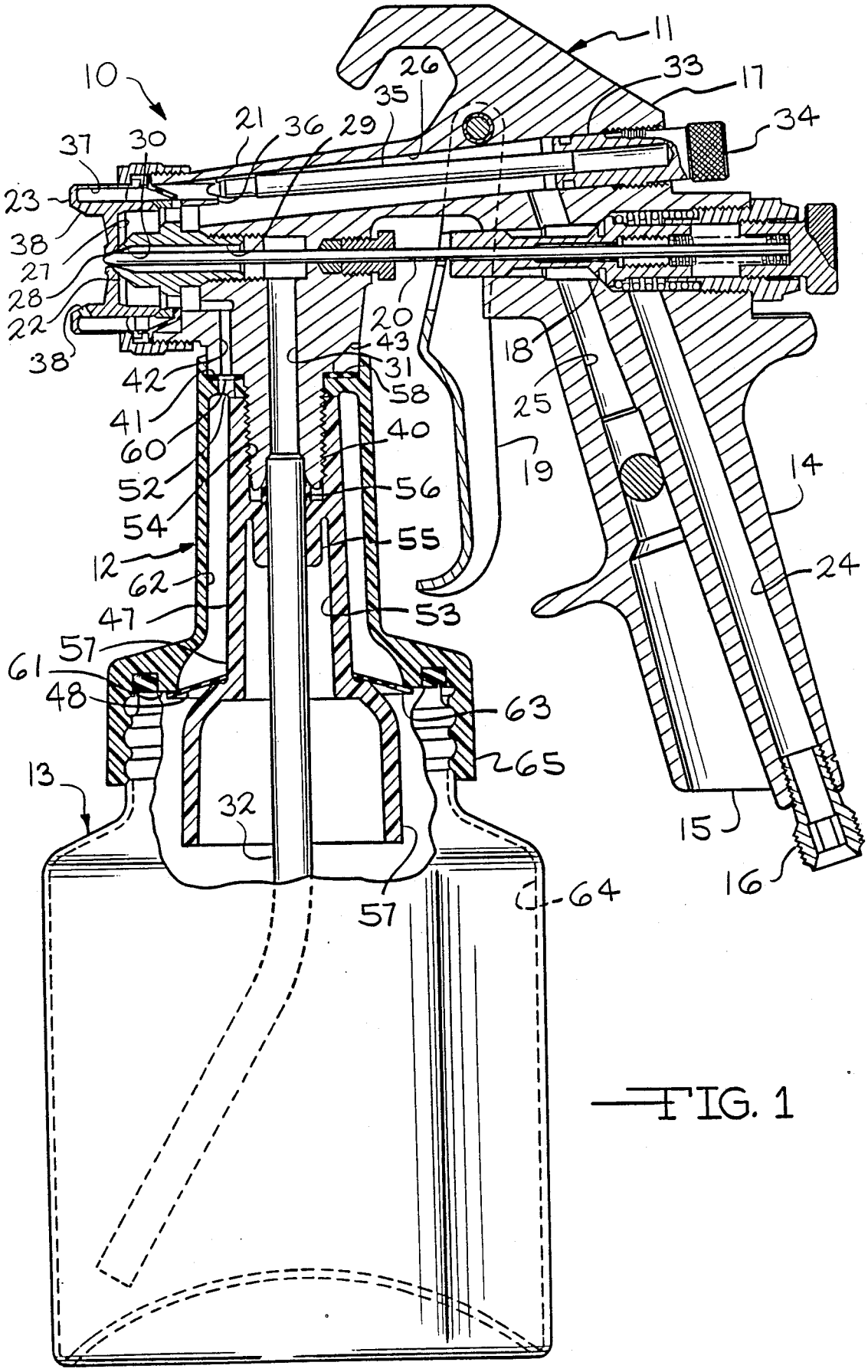
FIG. 1 is a vertical cross sectional view through a spray gun and paint cup and lid assembly according to the invention and showing the paint cup in a pressurized feed mode.

Turning to FIG. 1 of the drawings, a cross sectional view is shown through an assembly 10 including a spray gun 11, a lid assembly 12 and a paint cup 13. Except for modifications for attachment and operation of the lid assembly 12, the spray gun 11 may be a conventionally designed hand held air atomization type spray gun. The spray gun 11 includes a handle 14 terminating at a butt 15 in a fitting 16 for attachment to a compressed air hose (not shown). The handle 14 is integrally attached to a housing 17 in which an air valve 18 is mounted. A trigger 19 is pivotally mounted on the housing 17 for operating the air valve 18 and for moving a valve needle 20. The front of the housing 17 defines a barrel 21 on which a conventional fluid tip 22 and air cap 23 are mounted.

The air fitting 16 on the handle 14 connects to a passage 24 which extends through the handle 14 to the valve 18. When the trigger 19 is squeezed to open the air valve 18, air flows from the passage 24 through a passage 25 to a passage 26 in the housing 17. The passage 26 delivers air to a chamber 27 between the fluid tip 22 and the air cap 23. When the valve needle 20 is moved by the trigger 19, an orifice 28 in the air cap 23 is opened and compressed air from the chamber 27 is discharged. The valve needle 20 passes through the fluid tip 22 to the orifice 28. The fluid tip 22 has an interior chamber 29 surrounding the valve needle 20 which opens at a front 30 concentric with the orifice 28. When air flows through the orifice 28, fluid is sucked or aspirated from the chamber 29. The chamber 29 is connected through a passage 31 and a paint feed tube 32 to the bottom of the paint cup 13. Accordingly, the flow of air through the orifice 28 produces a suction feed of paint from the cup 13 through the tube 32, the passage 31, the chamber 29 and the orifice 28. As the paint is discharged with the flow of compressed air from the orifice 28, the paint is atomized.

The spray gun 11 also has a valve assembly 33 located in the housing 17. The valve assembly 33 includes an adjustment knob 34 and a valve needle 35. The adjustment knob 34 is manually turned to move the needle 35 toward and away from a seat 36 to control the flow of compressed air from the passage 26 into a chamber 37 in the air cap 23. The chamber 37 communicates with orifices 38 which direct air against the atomized paint to impart a flat or fan shape to the envelope of the atomized paint. When the valve needle 35 is against the seat 36, no air will flow through the orifices 38 and the atomized paint will have a round envelope.

Figure 2:
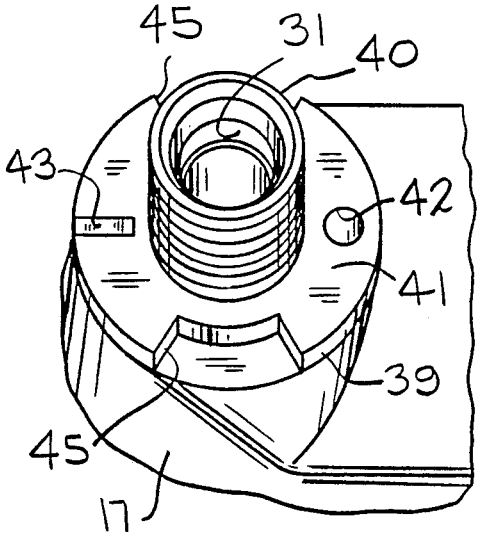
FIG. 2 is a fragmentary view showing the threaded nipple, the compressed air outlet, the vent notch and the shroud indexing arrangement on the button of the spray gun.

A portion 39 is formed integral with the housing 11 to depend from the barrel 21. A threaded nipple 40 extends below the bracket 39. The lid assembly 12 is attached to the nipple 40 and the paint cup 13 is attached to the lid assembly 12. The paint passage 31 extends through the bracket 39 and the nipple 40 and the paint feed tube 32 is held in an end of the passage 31 to extend below the nipple 40. Above the nipple 40, the bracket 39 has a downwardly facing surface 41, as best seen in FIGS. 1 and 2. A passage 42 communicates from the surface 41 to the atomization air chamber 27. A vent notch 43 also extends from the surface 41 to a rear surface 44 on the bracket 39. Relative to the nipple 40, the vent notch 43 is located diametrically opposite the compressed air passage 42. Two locating notches 45 are formed in the surface 41 at uniform radial spacing from and on opposite sides of the nipple 40. The notches 45 are equally spaced from the passage 42 and the vent notch 43.

Figure 3:
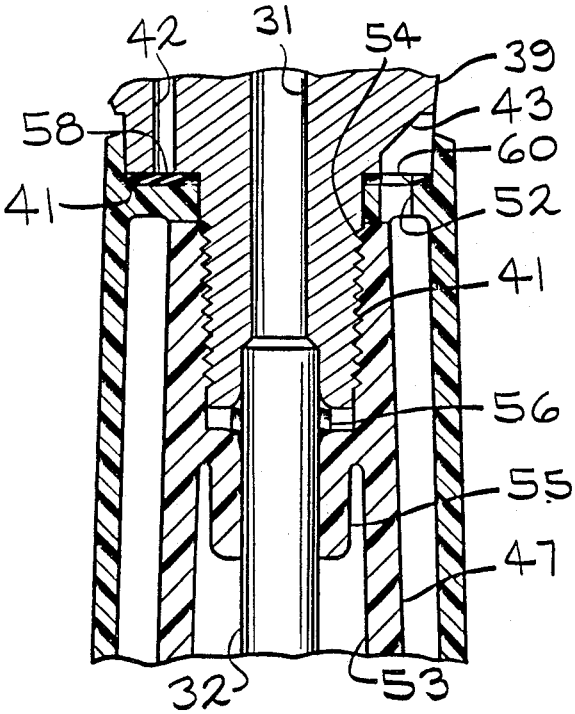
FIG. 3 is an enlarged fragmentary cross sectional view showing the attachment between the shroud and the spray gun when the paint cup is vented and operated in a suction feed mode.
Figure 5:
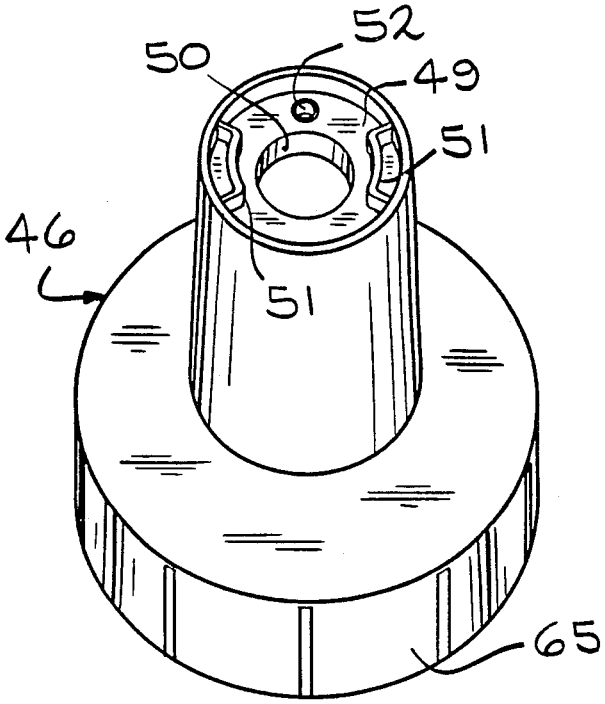
FIG. 5 is a perspective view of the shroud.

The lid assembly 12 includes a shroud 46, a retainer sleeve 47 and a disc or diaphragm 48. As best seen in FIGS. 1, 3 and 5, the shroud 46 is generally tubular shape and has an upper end 49 defining an opening 50 which is sized to receive the nipple. Two tabs 51 extend from the end 49 on diametrically opposite sides of the opening 50. The tabs 51 are shaped and located to be received by the notches 45 in the spray gun bracket surface 41. The tabs 51 and the notches 45 cooperate to permit attachment of the shroud 46 to the spray gun bracket in either of two positions rotated 180 degrees apart. A passage 52 extends through the shroud end 49. The passage 52 is located to align with the compressed air passage 42 in the bracket 39 when the shroud 46 is oriented in a first position, as shown in FIG. 1, and to align with the vent notch 43 when the shroud 46 is oriented in a second position relative to the bracket 39, as shown in fragmentary in FIG. 3.

Figure 4:
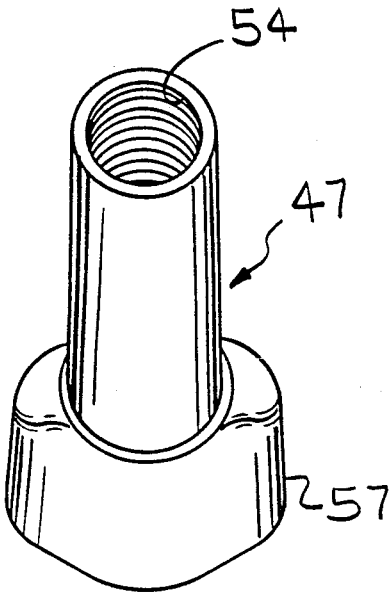
FIG. 4 is a perspective view of the retainer sleeve.

As best seen in FIGS. 1 and 4, the retainer sleeve 47 is generally tubular in shape and has a central opening 53. The retainer sleeve opening 53 has an internally threaded upper end 54 which engages the threaded nipple 40. The retainer sleeve opening 53 also has a reduced diameter portion 55 which receives and supports the paint feed tube 32. A plastic compression seal 56 is positioned on the tube 32 above the retainer sleeve portion 55. When the retainer sleeve 47 is threaded onto the nipple 40, the seal 56 is compressed between the nipple 40 and the retainer sleeve portion 55 to form a fluid seal and to hold the tube 32 in the end of the passage 31. The retainer sleeve 47 has an enlarged lower end 57, which preferably is slightly flattened or oval shaped in cross section to facilitate grasping when attaching the retainer sleeve 47 to or removing it from the nipple 40. The disc or diaphragm 48 is positioned on the retainer sleeve 47 and closely engages a shaft portion 59 of the sleeve 47 above the lower sleeve end 57.

In assembling the lid assembly 12 onto the spray gun 11, a user first determines if the assembly 10 will be used in a suction feed mode or in a pressure feed mode. For most materials such as relatively low viscosity paints and lacquers, the assembly 10 will be operated in a suction feed mode. A gasket 58 is positioned on the upper shroud end 49 with a gasket opening 60 aligned with the shroud opening 50 and the shroud 46 is positioned on the nipple 40 in the orientation shown in FIG. 3 with the shroud passage 50 aligned with the vent notch 43. The diaphragm 48 is positioned on the retainer sleeve 47, the paint feed tube 32 is inserted into the sleeve portion 55 and the seal 56 is positioned on the tube 32. The retainer sleeve 47 then is threaded onto the nipple 40 to firmly attach the shroud 47 to the spray gun 11 and to hold the paint feed tube 32 in the passage 31. When the retainer sleeve 47 is threaded onto the nipple 40, the disc or diaphragm 48 is slightly deflected downwardly at its perimeter by a downwardly facing lip 61 on the shroud 46. The diaphragm 48 closes the bottom of a chamber 62 between the shroud 46 and the retainer sleeve 47. At its top, the chamber 62 communicates through the passage 50 with the vent notch 43. At its bottom, the chamber 62 communicates through a notch 63 in the diaphragm 48 with an interior 64 of the paint cup 13 which is threaded onto a lower end 65 of the shroud 47. Thus, the interior of the paint cup 13 is vented to atmosphere through the diaphragm notch 63, the chamber 62, the passage 41 and the vent notch 43. The diaphragm 48 preferably is oriented with the notch 63 located towards the rear of the spray gun 11 and functions to prevent dripping from the vent notch 43 when the spray gun 11 is tipped during use.

For more viscous paint, it may be necessary to operate the assembly 10 in a pressure feed mode to obtain proper paint flow to the spray gun 11. Pressure feed is obtained by merely loosening or removing the retainer sleeve 47 on the nipple 40, moving the shroud 46 to withdraw the tabs 51 from the notches 45, rotating the shroud 180 degrees and finally retightening the retainer sleeve 47 on the nipple 40. As shown in FIG. 1, the shroud passage 50 will now align with the spray gun passage 42 and the shroud end 49 and the gasket 58 will block the vent notch 43. Consequently, the interior of the paint cup 13 is now closed from the atmosphere and is pressurized with compressed air from the chamber 27 whenever the spray gun trigger 19 is squeezed.

It will be appreciated that various changes and modifications may be made to the above described embodiment of the invention without departing from the spirit and the scope of the following claims. In particular, the invention is readily adaptable to many different conventional spray gun designs other than the specifically shown and described spray gun 11.

I claim:

1. A paint spray gun and paint cup and lid assembly for operation from a source of compressed air comprising, in combination, a spray gun having a threaded nipple and a suction paint feed tube extending from said nipple and connected to supply paint to a nozzle, a paint cup defining an open top and having a threaded end surrounding said open top, means attaching said paint cup to said spray gun with said paint feed tube extending into said paint cup including a shroud having a first end adapted to fit over said nipple and to abut the spray gun, said shroud having a second end threaded to engage said threaded paint cup end, a retainer having an internally threaded first end engaging said threaded nipple to retain said shroud on said spray gun, means cooperating between said spray gun and said shroud for indexing said shroud in either a first position or a second position relative to said spray gun, means for supplying compressed air from said spray gun to the interior of said paint cup to pressurize said paint cup when said shroud is in said first position, and means on said shroud for blocking the supply of compressed air from said gun to said paint cup and for simultaneously venting the interior of said paint cup to atmosphere when said shroud in in said second position.

2. A paint spray gun and paint cup and lid assembly for operation from a source of compressed air, as set forth in claim 1, wherein said retainer has a second end adapted to be manually grasped and turned to loosen and tighten said first retainer end on said nipple.

3. A paint spray gun and paint cup and lid assembly for operation from a source of compressed air, as set forth in claim 1, wherein said spray gun includes a compressed air passage having an opening adjacent said nipple, and wherein said means for supplying compressed air from said spray gun to said paint cup interior includes a passage through said first shroud end located to align with said compressed air passage opening in said spray gun when said shroud is in said first position.

4. A paint spray gun and paint cup and lid assembly for operation from a source of compressed air, as set forth in claim 3, wherein said means for selectively blocking the supply of compressed air to said paint cup and for venting said paint cup interior to atmosphere includes means for blocking said compressed air passage opening in said spray gun when said shroud is in said second position and a passage in said spray gun connecting said passage through said first shroud end to atmosphere when said shroud is in said second position.

5. A paint spray gun and paint cup and lid assembly for operation from a source of compressed air, as set forth in claim 4, and further including a diaphragm extending between said shroud adjacent said second shroud end and said retainer adjacent said second retainer end, said diaphragm forming a chamber within said shroud, said passage in said first shroud end opening into said chamber, and a passage in said diaphragm connecting said chamber to said paint cup interior.

* * * * *